US008170876B2

(12) United States Patent
Kagoshima et al.

(10) Patent No.: US 8,170,876 B2
(45) Date of Patent: May 1, 2012

(54) SPEECH PROCESSING APPARATUS AND PROGRAM

(75) Inventors: Takehiko Kagoshima, Kanagawa (JP); Noriko Yamanaka, Kanagawa (JP); Makoto Yajima, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 882 days.

(21) Appl. No.: 12/210,338

(22) Filed: Sep. 15, 2008

(65) Prior Publication Data

US 2009/0150157 A1 Jun. 11, 2009

(30) Foreign Application Priority Data

Dec. 7, 2007 (JP) ..... 2007-316637

(51) Int. Cl.
*G10L 13/00* (2006.01)
*G10L 21/00* (2006.01)
*G10L 13/08* (2006.01)

(52) U.S. Cl. ..... 704/258; 704/260; 704/270; 704/272

(58) Field of Classification Search ..... None
See application file for complete search history.

(56) References Cited

U.S. PATENT DOCUMENTS 5,966,691 A * 10/1999 Kibre et al. ..... 704/260
7,603,278 B2 * 10/2009 Fukada et al. ..... 704/260
7,676,368 B2 * 3/2010 Shizuka et al. ..... 704/260
2003/0093280 A1 * 5/2003 Oudeyer ..... 704/266
2009/0234652 A1 * 9/2009 Kato et al. ..... 704/260

FOREIGN PATENT DOCUMENTS

| | | |
|---|---|---|
| JP | 5-165486 | 7/1993 |
| JP | 7-121537 | 5/1995 |
| JP | 7-129619 | 5/1995 |
| JP | 9-258763 | 10/1997 |
| JP | 2001-34282 | 2/2001 |
| JP | 2007-86309 | 4/2007 |

OTHER PUBLICATIONS

Oudeyer, "The production and recognition of emotions in speech: features and algorithms", International Journal of Computer Studies, vol. 59, pp. 157-183, 2003.*
Office Action issued Jan. 31, 2012 in Japanese Application No. 2007-316637 filed Dec. 7, 2007 (w/English translation).

* cited by examiner

*Primary Examiner* — Brian Albertalli
(74) *Attorney, Agent, or Firm* — Oblon, Spivak, McClelland, Maier & Neustadt, L.L.P.

(57) ABSTRACT

A word dictionary including sets of a character string which constitutes a word, a phoneme sequence which constitutes pronunciation of the word and a part of speech of the word is referenced, an entered text is analyzed, the entered text is divided into one or more subtexts, a phoneme sequence and a part of speech sequence are generated for each subtext, the part of speech sequence of the subtext and a list of part of speech sequence are collated to determine whether the phonetic sound of the subtext is to be converted or not, and the phonetic sounds of the phoneme sequence in the subtext whose phonetic sounds are determined to be converted are converted.

18 Claims, 14 Drawing Sheets

FIG. 5

CHARACTER STRING LIST

| |
|---|
| TARO (IN KANJI) |
| JIRO (IN KANJI) |
| HANAKO (IN KANJI) |

FIG. 6

PHONETIC SOUND REPLACEMENT TABLE

| INPUT POSITION | OUTPUT POSITION |
|---|---|
| 1 | N |
| 2 | 1 |
| 3 | 2 |
| 4 | 3 |
| 5 | 4 |
| 6 | 5 |
| ▪ | ▪ |
| ▪ | ▪ |
| ▪ | ▪ |

FIG. 7

| TEXT | TARO SAN OHAYO ( GOOD MORNING, TARO ) | | |
|---|---|---|---|
| CHARACTER STRING | TARO | SAN | OHAYO |
| PHONEME SEQUENCE | TARO | SAN | OHAYO |
| PART OF SPEECH | UNIQUE NOUN | SUEFIX | INTERJECTION |
| PHONETIC SOUND CONVERSION | NO | YES | YES |
| OUTPUT PHONEME SEQUENCE | TARO | NSA | HAYOO |

| |
|---|
| [VARIABLE PORTION] SAN OHAYO |
| KYO HA [VARIABLE PORTION] NI IKIMASHO (LET'S GO TO [] TODAY) |
| OTSUKARESAMADESITA (GOOD WORK TODAY !) |
| II-TENKI-DESUNE (NICE DAY !) |

| |
|---|
| TARO |
| TARO LAND |
| HANAKO |

FIG.14A

| CHARACTER STRING | PHONEME SEQUENCE | PART OF SPEECH |
|---|---|---|
| SAN | SAN | SUEFIX |
| KUN | KUN | SUEFIX |
| SAMA | SAMA | SUEFIX |
| . | . | . |
| . | . | . |
| OHAYO | OHAYO | INTERJECTION |
| KONNICHIWA | KONNICHIWA | INTERJECTION |
| KONBANWA | KONBANWA | INTERJECTION |
| . | . | . |
| . | . | . |

FIG.14B

| CHARACTER STRING | PHONEME SEQUENCE | PART OF SPEECH |
|---|---|---|
| SAN | NSA | SUEFIX |
| KUN | NKU | SUEFIX |
| SAMA | MASA | SUEFIX |
| . | . | . |
| . | . | . |
| OHAYO | HAYOO | INTERJECTION |
| KONNICHIWA | NNICHIWAKO | INTERJECTION |
| KONBANWA | NBANWAKO | INTERJECTION |
| . | . | . |
| . | . | . |

FIG.14C

| CHARACTER STRING | PHONEME SEQUENCE | PART OF SPEECH |
|---|---|---|
| TARO | TARO | UNIQUE NOUN |
| HANAKO | HANAKO | UNIQUE NOUN |

FIG.16A

PHONETIC SOUND CONVERSION TABLE

| INPUT SYLLABLE | OUTPUT SYLLABLE |
|---|---|
| A | I |
| I | O |
| U | A |
| E | U |
| O | E |
| KA | SHI |
| KI | SO |
| KU | SA |
| KE | SU |
| KO | SE |
| SA | CHI |
| SI | TO |
| SU | TA |
| SE | TSU |
| SO | TE |
| . | . |
| . | . |
| . | . |
| N | N |

FIG.16B

PHONETIC SOUND CONVERSION TABLE

| INPUT SYLLABLE | OUTPUT SYLLABLE |
|---|---|
| A | I→O |
| I | O→E |
| U | A→I |
| E | U→A |
| O | E→U |
| KA | SHI |
| KI | SO |
| KU | SA |
| KE | SU |
| KO | SE |
| SA | CHI |
| SI | TO |
| SU | TA |
| SE | TSU |
| SO | TE |
| · | · |
| · | · |
| · | · |
| N | N |

FIG.16C

PHONETIC SOUND CONVERSION TABLE

| INPUT SYLLABLE | OUTPUT SYLLABLE |
|---|---|
| A | I (0.5), O (0.5) |
| I | O (0.7), E (0.3) |
| U | A (0.9), I (0.1) |
| E | U (0.6), A (0.4) |
| O | E (0.8), U (0.2) |
| KA | SHI |
| KI | SO |
| KU | SA |
| KE | SU |
| KO | SE |
| SA | CHI |
| SI | TO |
| SU | TA |
| SE | TSU |
| SO | TE |
| ▪ | ▪ |
| ▪ | ▪ |
| ▪ | ▪ |
| N | N |

FIG.17

| TEXT | TARO SAN OHAYO ( GOOD MORNING, TARO ) | |
|---|---|---|
| CHARACTER STRING | TARO-SAN | OHAYO |
| PHONEME SEQUENCE | TARO-SAN | OHAYO |
| PART OF SPEECH | UNIQUE NOUN+SUEFIX | INTERJECTION |
| PHONETIC SOUND CONVERSION | NO | YES |
| OUTPUT PHONEME SEQUENCE | TARO-SAN | HAYOO |

SPEECH PROCESSING APPARATUS AND PROGRAM

CROSS-REFERENCE TO RELATED APPLICATIONS

This application is based upon and claims the benefit of priority from the prior Japanese Patent Application No. 2007-316637, filed on Dec. 7, 2007; the entire contents of which are incorporated herein by reference.

TECHNICAL FIELD

The present invention relates to a speech synthesizing apparatus configured for synthesizing speech from a given text and, more specifically, to a speech processing apparatus for entertainment application such as video and game, and a program of the same.

BACKGROUND OF THE INVENTION

In the related art, a technology of text-speech synthesis for creating speech signals artificially from a given sentence (text) has been proposed. A speech synthesizing apparatus which realizes the text-speech synthesis as such generally includes three units of a language processing unit, prosody processing unit and a speech synthesizing unit.

The speech synthesizing apparatus is operated as follows.

First of all, morpheme analysis or syntax analysis of an entered text is carried out in the language processing unit to divide the text into the unit, for example, of morpheme, word or accent phrase, and generate a phoneme sequence or a part of speech sequence for each unit.

Subsequently, processing of accent or intonation is carried out in a prosody processing unit to calculate information such as a basic frequency and a phonetic sound duration.

Lastly, in a speech synthesizing unit, characteristic parameters or speech waveforms referred to as speech unit data stored for each unit of synthesis, which is a unit of connection of the speech when generating a synthesized speech in advance (for example, phoneme, syllable, etc.), are connected on the basis of the basic frequency or the phonetic sound duration calculated in the prosody processing unit.

The technology of text-speech synthesis as described above is used for speech message outputs of characters in video games (see JP-A-2001-34282 (Kokai)). In the speech message output by reproduction of the recorded speech in the related art, only pre-recorded terms can be reproduced as a speech. However, with the employment of the text-speech synthesis, production of terms which cannot be recorded in advance, such as names entered by players, as a speech is enabled.

As described above, the text-speech synthesis may be used in speech messages of characters in video games, in particular, of humans or human-type robots.

However, there are characters which are not suitable to speak the same language as the human (for example, Japanese language). For example, in the case of a character such as "Intellectually gifted Alien", it is not unnatural when it speaks language. However, if it speaks Japanese or other existing language, a problem of lack of authenticity arises.

In this case, it is possible to use meaningless effect sounds instead of speech. However, in this case, it does not sound like a language, and hence a problem of lack of authenticity also arises.

BRIEF SUMMARY OF THE INVENTION

Accordingly, it is an object of the present invention to provide a speech processing apparatus for generating a phoneme sequence which is able to be used for speech synthesis to generate a synthesized speech which is meaningless but sounds like a language and has a ring of truth, and a program of the same.

According to embodiments of the present invention, there is provided a speech processing apparatus including an input unit configured to enter a text; a dictionary including sets of a character string which constitutes a word, a phoneme sequence which constitutes pronunciation of the word and a part of speech of the word; a generating unit configured to divide the text into one or more subtexts on the basis of the dictionary and generate speech information including a phoneme sequence for each divided subtext; a determining unit configured to cross-check the speech information of the subtext and a list of speech information stored in advance and determine whether or not to carry out conversion of phonetic sounds which belong to the phoneme sequence of the subtext; and a processing unit configured to (1) convert each phonetic sound in the phoneme sequence of the subtext, which is determined to be carried out the conversion of phonetic sounds, into a different phonetic sound according to a conversion rules stored in advance and output the same, and (2) output the phoneme sequence of the subtext, which is determined not to be carried out the conversion of phonetic sound, without carrying out the conversion.

There is also provided a speech processing apparatus including an input unit configured to enter a text and determination information which indicates portions to be converted and portions not to be converted into different phonetic sounds in the text and, a dictionary including sets of a character string which constitutes a word, a phoneme sequence which constitutes pronunciation of the word and a part of speech of the word; a generating unit configured to divide the text into one or more subtexts on the basis of the dictionary and the determination information and generate information including the phoneme sequence with an attribute indicating whether the conversion is necessary or not for each divided subtext; and a processing unit configured to (1) convert each phonetic sound in the phoneme sequence of the subtext, whose attribute indicates that the conversion is necessary, into a different phonetic sound according to conversion rules stored in advance and output the same, and (2) output the phoneme sequence of the subtext, whose attribute indicates that the conversion is not necessary, without carrying out the conversion.

There is provided a speech processing apparatus including: an input unit configured to enter a text; a first dictionary including sets of a character string which constitutes the word whose phonetic sounds are to be converted, a converted phoneme sequence in which a combination of phonetic sounds which constitutes pronunciation of the word is converted into a combination of different phonetic sounds on the basis of given conversion rules and a part of speech of the word; a second dictionary including sets of a character string which constitutes the word whose phonetic sounds are not to be converted, a no-conversion phoneme sequence which constitutes pronunciation of the word as it is, and a part of speech of the word; and a processing unit configured to (1) divide the text into one or more subtexts on the basis of the first dictionary and the second dictionary, (2) generate the converted phoneme sequence of the subtext included in the first dictionary on the basis of the first dictionary and output the same, and (3) generate the no-conversion phoneme sequence of the subtext included in the second dictionary on the basis of the second dictionary and output the same.

According to an aspect of the invention, a synthesized speech which is meaningless while maintaining its languageness grammatically, phonetically and prosodically.

BRIEF DESCRIPTION OF THE DRAWINGS

FIG. 5 shows an example of a character string list stored in a no-conversion list storage unit;

FIG. 6 shows an example of conversion rules;

FIG. 7 shows an example of output after having converted the phonetic sound string;

FIG. 14A shows an example of word information stored in a language dictionary storage unit;

FIG. 14B shows an example in which a phonetic sound converting unit converts a phoneme sequence in the language dictionary storage unit on the basis of a phonetic sound replacement table;

FIG. 14C shows an example of word information stored in a no-conversion language dictionary storage unit;

FIG. 16 is a conversion table according to Modification 1; and

FIG. 17 is a table in which the unit is replaced by accent phrase according to Modification 2.

DETAILED DESCRIPTION OF THE INVENTION

A speech synthesizing apparatus according to embodiments of the invention will be described below.

First Embodiment

Referring now to FIG. 1 to FIG. 7, the speech synthesizing apparatus according to a first embodiment will be described.

(1) Configuration of Speech Synthesizing Apparatus

Figure 1:
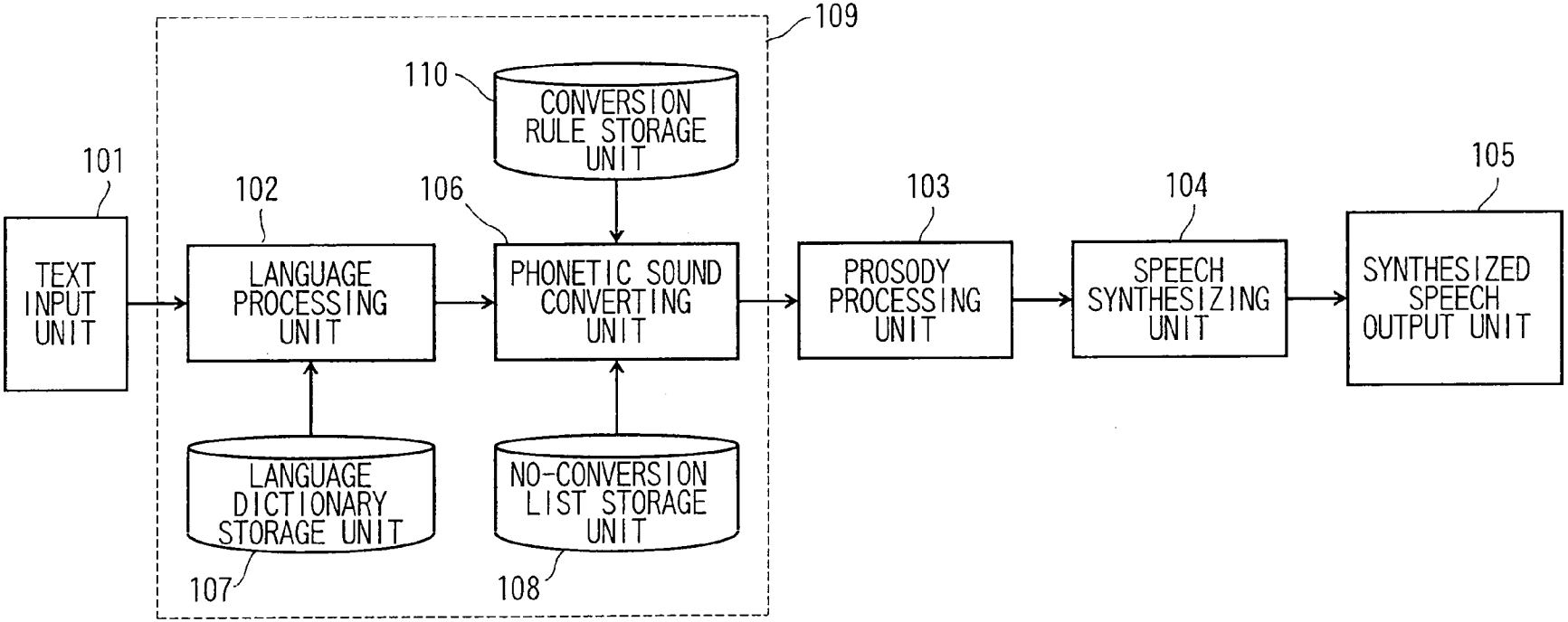
FIG. 1 is a block diagram showing a speech synthesizing apparatus according to a first embodiment of the invention.

Referring now to FIG. 1, the configuration of the speech synthesizing apparatus in the first embodiment will be described. FIG. 1 is a block diagram showing the speech synthesizing apparatus.

The speech synthesizing apparatus includes a text input unit 101 configured to enter a text, a phoneme sequence generating unit 109 configured to generate a phoneme sequence or a part of speech of each word from the text entered from the text input unit 101, a prosody processing unit 103 configured to generates prosody information such as pitch and the duration of each phonetic sound from information described above, a speech synthesizing unit 104 configured to generate a synthesized speech from the phoneme sequence and the prosody information, and a synthesized speech output unit 105 configured to output the synthesized speech generated in the speech synthesizing unit 104.

The speech synthesizing apparatus may be realized also by using, for example, a multipurpose computer apparatus as a basic hardware. In other words, the phoneme sequence generating unit 109, the prosody processing unit 103, and the speech synthesizing unit 104 may be realized by causing a processor mounted to the computer apparatus to execute a program. At this time, the speech synthesizing apparatus may be realized by installing the program in the computer apparatus in advance, or by installing the program to the computer apparatus as needed by storing the program in a storage device such as a CD-ROM or the like and distributing the program via a network. The text input unit 101 may be realized by using a keyboard integrated in the computer apparatus or connected thereto as needed. The synthesized speech output unit 105 may be realized by using a speaker integrated in the computer apparatus or connected thereto and a head phone as needed.

(2) Prosody Processing Unit 103, Speech Synthesizing Unit 104

The prosody processing unit 103 and the speech synthesizing unit 104 may be realized by using a prosody processing method and a speech synthesizing method known in the related art, respectively.

For example, in order to generate the pitch in the prosody processing, there is a method of generating a variation pattern of the pitch in one sentence by selecting and connecting the variation pattern of the pitch in each typical accent phrase, and in order to generate the duration of the phonetic sound, there is a method of using an estimation model on the basis of Quantification type 1.

As the speech synthesizing method, there is a method of selecting a speech waveform (speech unit) for each phoneme and syllable according to the phoneme sequence, deforming the prosody according to the prosody information, and connecting the same.

(3) Configuration of Phoneme Sequence Generating Unit 109

Subsequently, the phoneme sequence generating unit 109 will be described on the basis of FIG. 1.

The phoneme sequence generating unit 109 includes a language processing unit 102, a language dictionary storage unit 107, a phonetic sound converting unit 106, a no-conversion list storage unit 108 and a conversion rule storage unit 110 as shown in FIG. 1.

The language dictionary storage unit 107 stores information of a number of Japanese words, and the information of each word includes a notation (character string) having Kanji (Chinese characters) and Hiragana (Japanese phonetic sign) mixed therein, a phoneme sequence which constitutes pronunciation, a part of speech, conjugation, an accent position.

The language processing unit 102 analyzes the entered text by referencing the word information stored in the language dictionary storage unit 107, delimiting the entered text into words, and outputs the speech information on each word, such as the phoneme sequence, the part of speech, and the accent position.

The phonetic sound converting unit 106 determines whether to convert the phoneme sequence of the word or not by referencing the list of the speech information stored in the no-conversion list storage unit 108 and, when it is determined to convert, converts the phoneme sequence of the word according to the conversion rules stored in the conversion rule storage unit 110 and outputs the converted phoneme sequence.

(4) Operation of Phoneme Sequence Generating Unit 109

Figure 2:
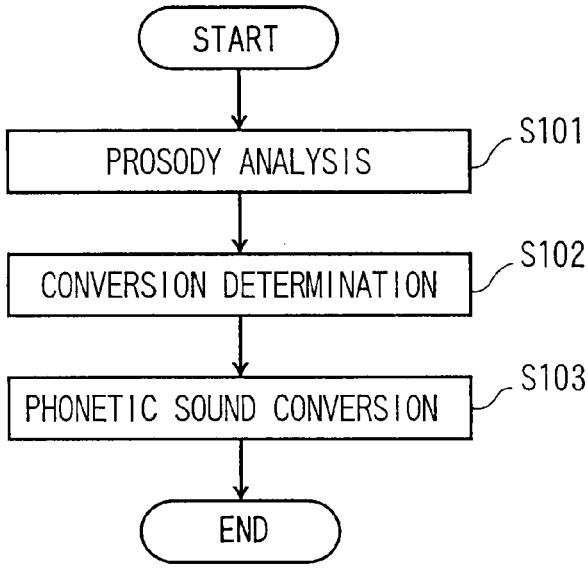
FIG. 2 is a flowchart showing an operation of a phonetic sound generating unit.

Referring now to FIG. 2 to FIG. 7, the operation of the phoneme sequence generating unit 109 will be described. FIG. 2 is a flowchart showing the operation of the phoneme sequence generating unit 109.

(4-1) Language Processing Unit 102

The language processing unit 102 analyzes the morpheme of the text entered in the text input unit 101 (Step S101). As an example, an analysis of a text "Taro-san-ohayo (Good morning, Taro) will be described.

Figure 3:
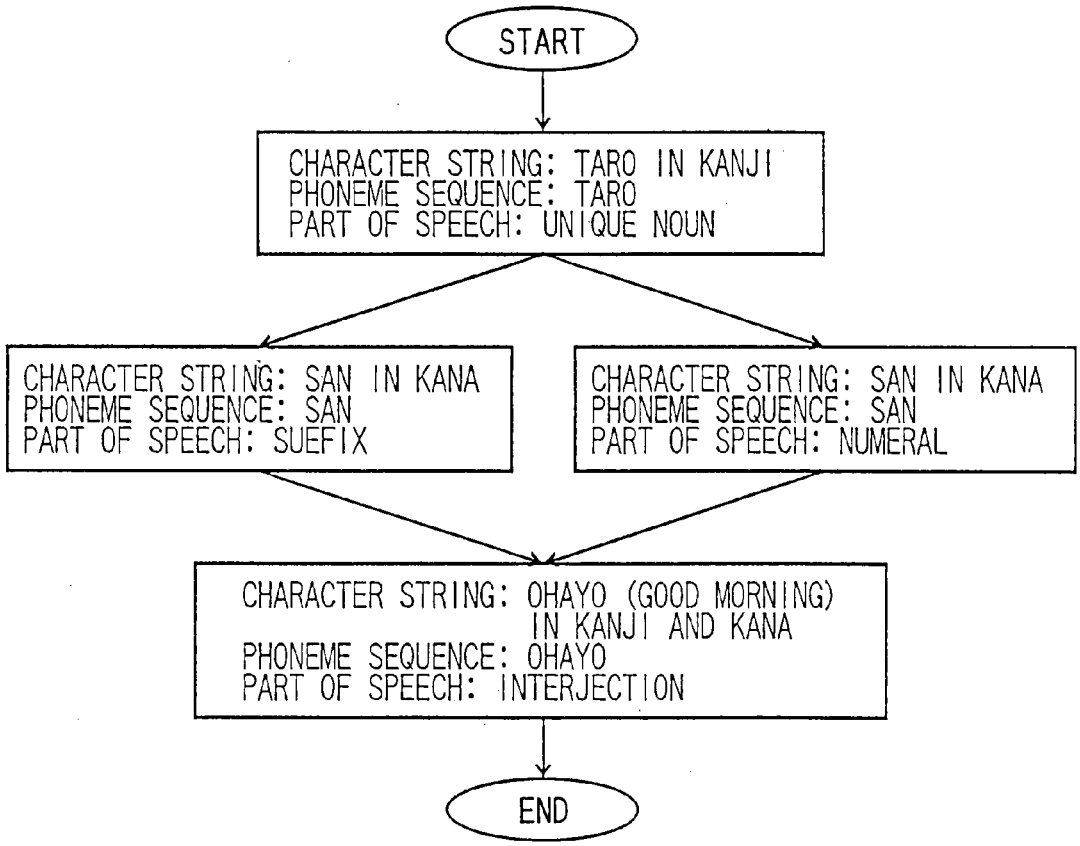
FIG. 3 is a network showing a word string.

The word information in the language dictionary storage unit 107 is referenced and the input text is expressed by a word sequence. The word sequence is not necessarily determined to be one type and, for example, it is expressed in a network as shown in FIG. 3. In this example, since the word "san" has two usage; one is the usage as a suffix and the other one is the usage as a numeral, the network shows that there are two analytical results.

Subsequently, referring to the rules about easiness of connection between words using the part of speech of the word or the like, scores are given to candidates (network passes) of the analytical result.

Figure 4:
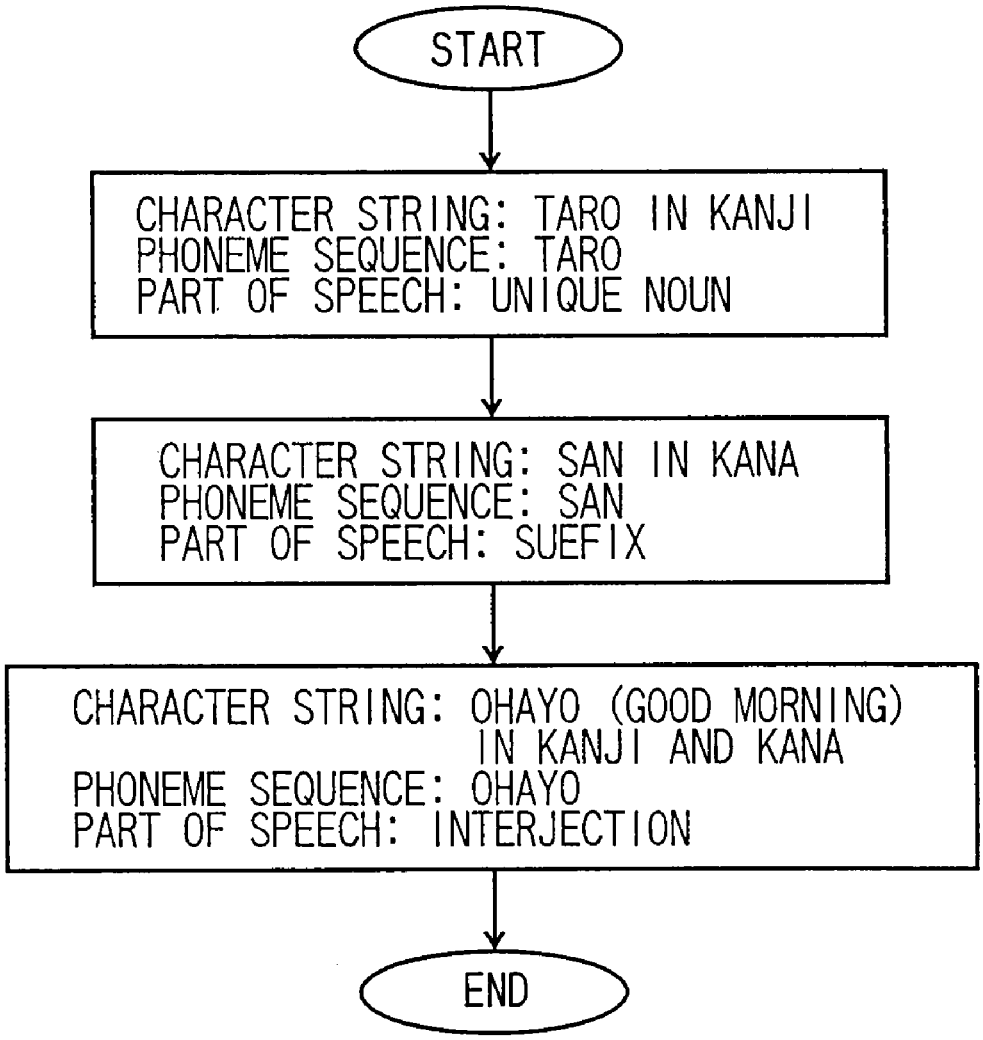
FIG. 4 shows an example of an analytical result of a character string, a phonetic sound string and a part of speech of each word.

Lastly, the scores of the candidates are compared, and the highest likelihood pass is selected, and the character string, the phoneme sequence, and the part of speech of each word are outputted as the analytical result. In this example, since the unique noun is often connected to the suffix, the result shown in FIG. 4 is outputted.

(4-2) Phonetic Sound Converting Unit 106

Subsequently, the phonetic sound converting unit 106 references the result of morpheme analysis, and determines whether or not conversion of the phonetic sounds of each word is carried out (Step S102).

The determination is carried out on the basis of the speech information list stored in the no-conversion list storage unit 108. The speech information list is a list having the speech information as elements. The speech information is information obtained for each word as a result of delimiting the entered text into words, and analyzing while referencing the word information, and includes, for example, the phoneme sequence, the character string, the part of speech, and the accent position. The list may include any one of those (for example, the character string), or may include various types mixed therein (for example, the character string and the part of speech). Alternatively, the list may includes a plurality of combinations such as "the character string is 'Chiba' and the part of speech is 'personal name' " as elements. An example of the case in which the speech information list is the character string list will be shown in FIG. 5.

The character string of each word in the entered word sequence is collated with the character string list. When there is a match, it is determined that the phonetic sound conversion of the word is not to be carried out. When nothing matches, it is determined that the phonetic sound conversion is to be carried out. In this example, since the word "Taro" exists in the character string list, it is determined not to be converted, and since the words "san" and "ohayo" do not exit, they are determined to be converted.

Then, the phonetic sound of the word which is determined to be converted according to the conversion rules stored in the conversion rule storage unit 110 (Step S103).

The conversion of the phonetic sound is an operation to output a different phonetic sound from the entered phonetic sound on the basis of at least the entered phonetic sound and the conversion rules. The conversion rules is used at least when converting the entered phonetic sound to a phonetic sound different from the entered phonetic sound, and is rules to follow when a certain entered phonetic sound is converted into a different phonetic sound.

The conversion of the phonetic sound in the first embodiment is realized by replacing the positions of the phonetic sounds in the word. An example of the conversion rules is shown in FIG. 6. This table includes the position of the phonetic sound in the entered word and the position of the phonetic sound in the word to be outputted after the replacement, and the sign N corresponds to the number of phonetic sounds in the word. An example of output in which the phoneme sequence of the words "san" and "ohayo" are converted using the conversion rules is shown in FIG. 7.

(5) Advantages

With the speech synthesizing apparatus in the first embodiment, when the text "Taro-san-ohayo." is entered, a speech "taro-nsa-hayooo" is synthesized.

In this manner, since the phonetic sound and the intonation have the same characteristics as Japanese language, it is possible to synthesize a speech which is meaningless but is provided with "languageness", so that the speech can be used as the speech of the character in the game.

Since the personal name is pronounced in the same manner even when the language is different, by adapting the apparatus not to convert specific words such as the name entered by the player, reality is effectively increased.

Depending on the method of conversion to use, the text before conversion can be analogized. Therefore, an entertainment property such as to analogize the meaning of the speech spoken by the character in the game is provided.

(6) Modification

In the phonetic sound converting unit 106 in the first embodiment, whether to convert or not is determined by referencing the character string list. However, the method of determination is not limited thereto, and may be determined by referencing the phoneme sequence list or the part of speech list.

For example, when the phoneme sequence list includes a registration of the word "Hiroshi", the words which are pronounced as "Hiroshi" as the personal name are not converted and synthesized with its original phonetic sound irrespective of the Kanji used.

When the part of speech list includes a registration of "Unique Noun", the unique nouns such as the personal name are not converted. When the input interface of the game cannot be entered with Kanji and only accept Kana input, collation with the phoneme sequence makes mounting easier.

The ratio of the converting portion may be controlled easily by controlling the determination of conversion by the part of speech, and, by increasing the number of parts of speech in the no-conversion list, the portions to be converted are decreased, so that a representation such as "the character is gradually learning Japanese" is created.

Second Embodiment

Referring now to FIG. 8 to FIG. 12, the speech synthesizing apparatus according to a second embodiment of the present invention will be described.

(1) Configuration of Speech Synthesizing Apparatus

Figure 8:
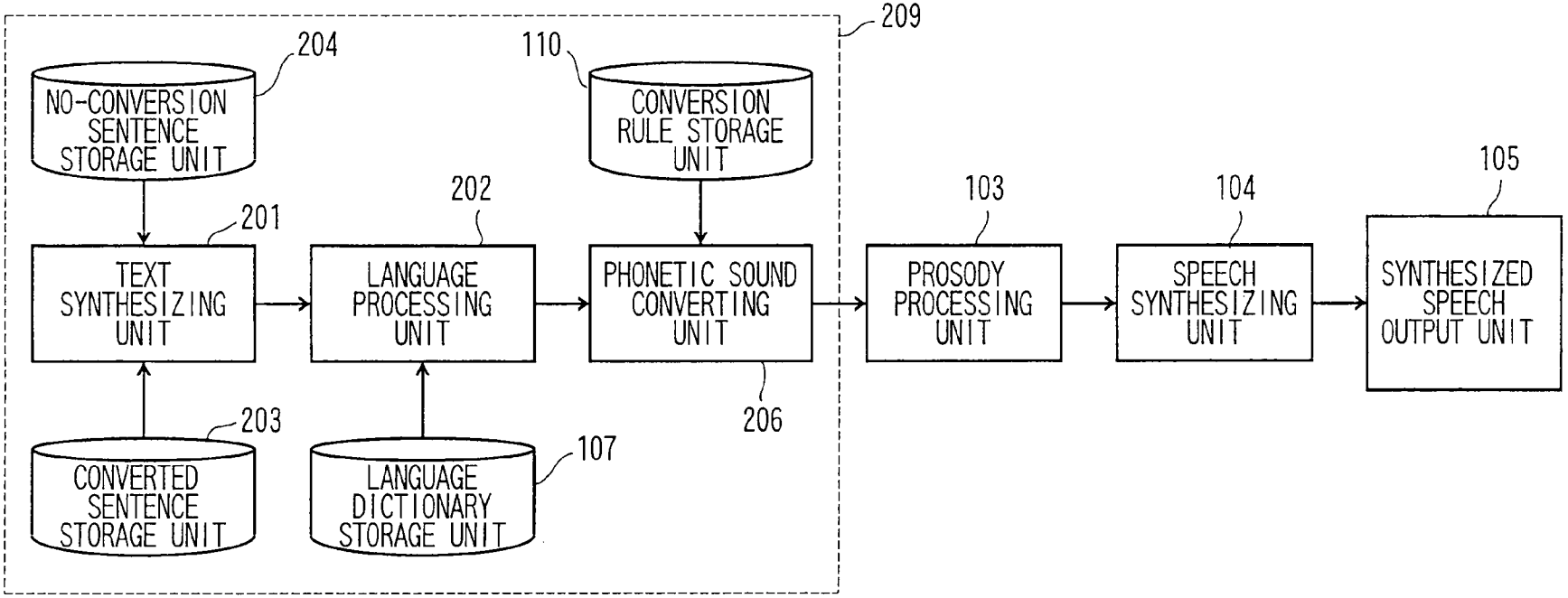
FIG. 8 is a block diagram showing the speech synthesizing apparatus according to a second embodiment.

FIG. 8 is a block diagram showing the speech synthesizing apparatus. The components having the same functions as those shown in FIG. 1 are designated by the same reference numerals and description is omitted.

The speech synthesizing apparatus according to the second embodiment includes a text synthesizing unit 201, a converted sentence storage unit 203 and a no-conversion sentence storage unit 204 added thereto.

The converted sentence storage unit 203 stores texts whose phonetic sounds are to be converted. The no-conversion sentence storage unit 204 stores texts whose phonetic sounds are not to be converted. For example, texts in established portions of speeches of the game characters are stored in the converted sentence storage unit 203 in advance, and the names entered by the player or the like are registered in the no-conversion sentence storage unit 204.

(2) The Operation of the Speech Synthesizing Apparatus

Figures 9, 10, 11:
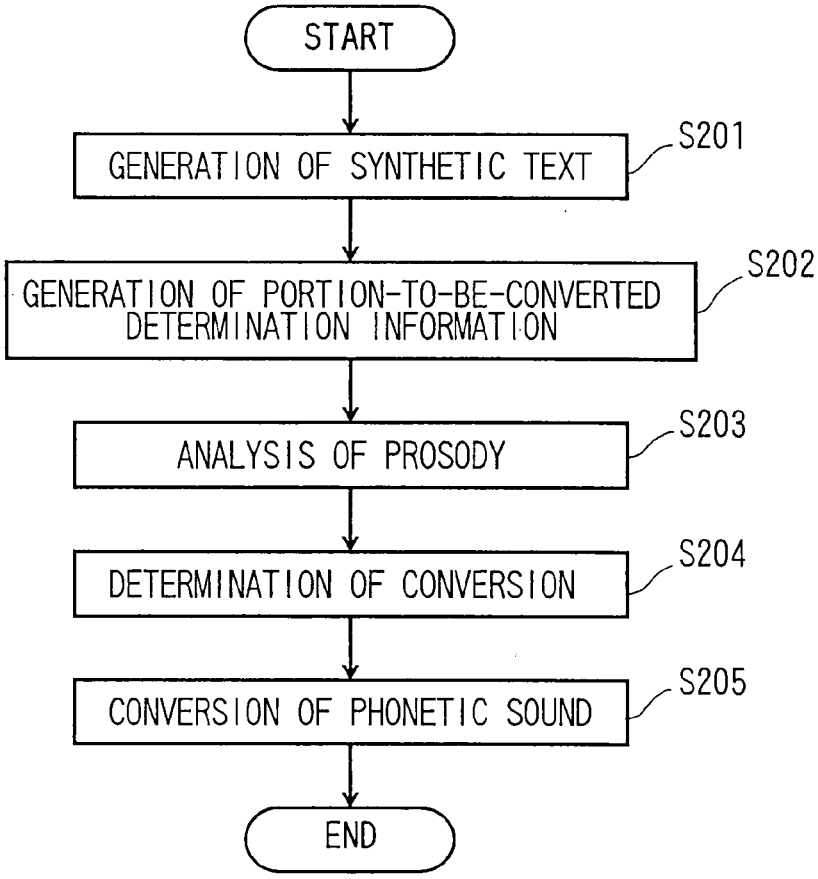
FIG. 9 is a list of texts stored in a converted sentence storing unit.
FIG. 10 is a list of texts stored in a no-conversion sentence storage unit.
FIG. 11 is a flowchart showing an operation of phonetic sound generating unit.
Figure 12:
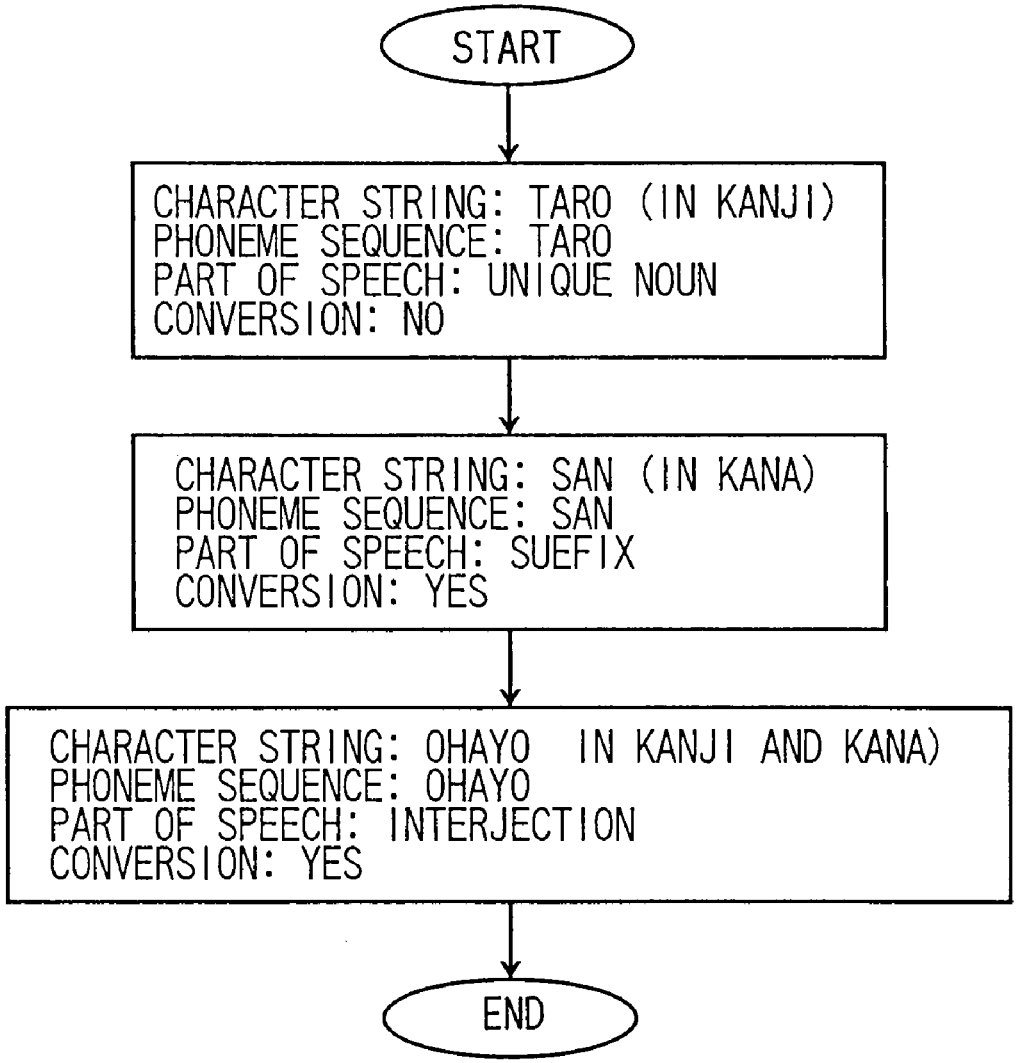
FIG. 12 shows an example of output from a language processing unit.

Referring now to FIG. 9 to FIG. 11, the operation of a phonetic sound generating unit 209 in the speech synthesizing apparatus according to the second embodiment will be described. FIG. 11 is a flowchart showing the operation of the phonetic sound generating unit 209.

(2-1) Text Synthesizing Unit 201

The text synthesizing unit 201 generates an input text by combining specified texts in the converted sentence storage unit 203 and the no-conversion sentence storage unit 204 (Step S201).

Then, the text synthesizing unit 201 generates determination information which indicates portions whose phonetic sounds are to be converted and portions whose phonetic sounds are not to be converted in the input text (Step S202).

The determination information may be realized by inserting into the input text as a tag or outputting data indicating the boundary positions between the conversion and the non-conversion and discrimination whether to convert or not to convert of each section separately from the input text.

For example, a case in which a list of texts as shown in FIG. 9 is stored in the converted sentence storage unit 203 and a list of texts as shown in FIG. 10 is stored in the no-conversion sentence storage unit 204 will be described.

An input text is generated by inserting the text specified in FIG. 10 in a "variable portion" in FIG. 9. When "'variable portion"-san-ohayo'" is specified form FIG. 9 and "Taro" is specified from FIG. 10, an input text "<no-conversion> Taro </no-conversion>-san-ohayo" is generated as a result of combination. Here, <no-conversion> and </no-conversion> are tags which indicates the beginning and the end of the section in the input text, in which phonetic sounds are not to be converted. The tag indicating the section to be converted may be used instead of the tags indicating the section not to be converted.

It is also possible to output information "the section of a length from the first character to the second character is the section not to be converted" as a portion-to-be-converted information instead of the tag.

(2-2) Language Processing Unit 202

Subsequently, a language processing unit 202 divides an input text into words and generates a character string, phoneme sequence and a part of speech of each word as in the case of the morpheme analysis in the first embodiment (Step S102).

Then, the attribute indicating conversion or no-conversion is given to each word referencing portion-to-be-converted information. An example of output from the language processing unit 202 is show in FIG. 12.

(2-3) Phonetic Sound Converting Unit 206

Subsequently, a phonetic sound converting unit 206 references the attribute indicating conversion or no-conversion of the output from the language processing unit 202, and determines the word whose phonetic sound is to be converted (Step S204).

Then, the conversion of the phonetic sounds is carried out for the words whose phonetic sounds are determined to be converted according to the conversion rules stored in the conversion rule storage unit 110 (Step S205).

The conversion of the phonetic sound is realized by replacing the positions of the phonetic sounds in the word as in the case of the first embodiment. When the input text is "<no-conversion> Taro </no-conversion>-san-ohayo", the generated phoneme sequence will be "taro-nsa-hayooo".

Then, the prosody information is generated in the prosody processing unit 103 on the basis of the phoneme sequence, the speech "taro-nsa-hayooo" is synthesized by the speech synthesizing unit 104 and outputted from the synthesized speech output unit 105.

(3) Advantages

With the speech synthesizing apparatus according to the second embodiment as well, the speech "taro-nsa-hayooo" is synthesized from the text "Taro-san-ohayo", and the same advantages as the first embodiment are achieved.

Third Embodiment

Referring now to FIG. 13 to FIG. 16, the speech synthesizing apparatus according to a third embodiment of the invention will be described.

(1) Configuration of Speech Synthesizing Apparatus

Figure 13:
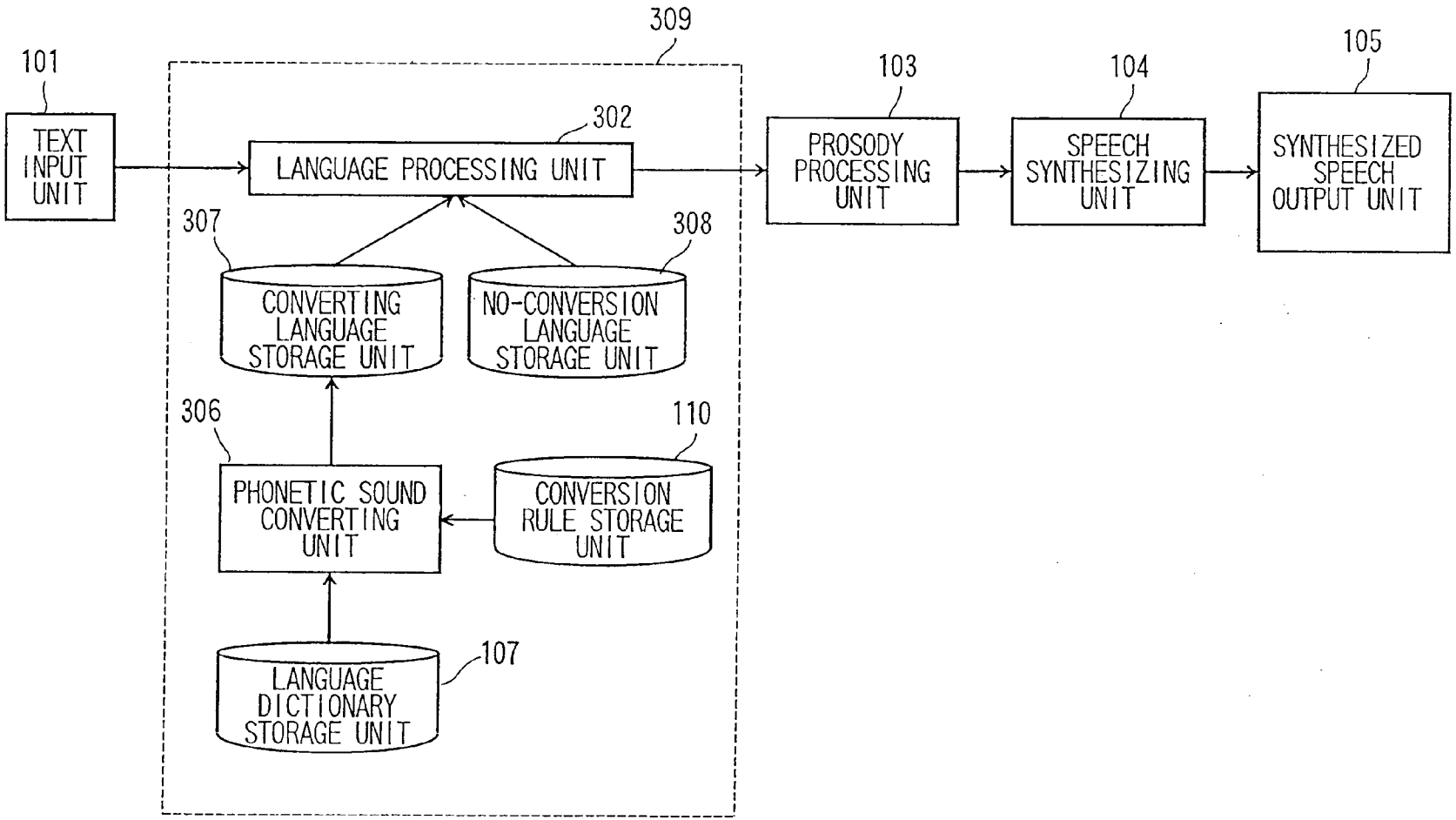
FIG. 13 is a block diagram showing the speech synthesizing apparatus according to a third embodiment.

Referring to FIG. 13, the configuration of the speech synthesizing apparatus in the third embodiment will be described. FIG. 13 is a block diagram showing the speech synthesizing apparatus, in which components having the same functions as those in FIG. 1 and FIG. 8 are designated by the same reference numeral and description is omitted.

A phoneme sequence generating unit 309 in the third embodiment includes a language processing unit 302, a converting language storage unit 307, a no-conversion language storage unit 308, a phonetic sound converting unit 306, the conversion rule storage unit 110, and the language dictionary storage unit 107.

The language processing unit 302 operates by referencing the two language dictionaries; the converting language storage unit 307 and the no-conversion language storage unit 308. Information of the words stored in the converting language storage unit 307 is the same as that stored in the language dictionary storage unit 107. However, the phoneme sequence information is converted in advance on the basis of the conversion rules.

In other words, the phonetic sound converting unit 306 converts the phoneme sequence information of all the words in the language dictionary storage unit 107 on the basis of the conversion rules stored in the conversion rule storage unit 110, and stores the conversion phoneme sequence and other information (such as the character string, the part of speech, conjugation, and the accent position) in the converting language storage unit 307.

(2) Operation of Speech Synthesizing Apparatus

Subsequently, the operation of the speech synthesizing apparatus according to the third embodiment will be described.

An example of the word information stored in the language dictionary storage unit 107 is shown in FIG. 14A. The conversion rule storage unit 110 stores a phonetic sound replacement table shown in FIG. 5.

(2-1) Phonetic Sound Converting Unit 306

The phonetic sound converting unit 306 converts the phoneme sequence in the language dictionary storage unit 107 on the basis of the phonetic sound replacement table to generate the word information shown in FIG. 14B, and stores the same in the converting language storage unit 307.

It is assumed that the non-conversion language storage unit 308 stores the word information shown in FIG. 14C.

(2-2) Language Processing Unit 302

Assuming that the text "Taro-san-ohayo" is entered from the text input unit 101, the language processing unit 302 carries out the morpheme analysis in the same manner as the language processing unit 102 in the first embodiment, and outputs the character string, the phoneme sequence and the part of speech sequence of each word as the analytic result. However, the language processing unit 302 in the third embodiment references the two language dictionaries; the converting language storage unit 307 and the no-conversion language storage unit 308.

When the word having the same character string exists in the both two dictionaries, the registration in the no-conversion language storage unit 308 is given with a priority to be used for the analysis.

Figure 15:
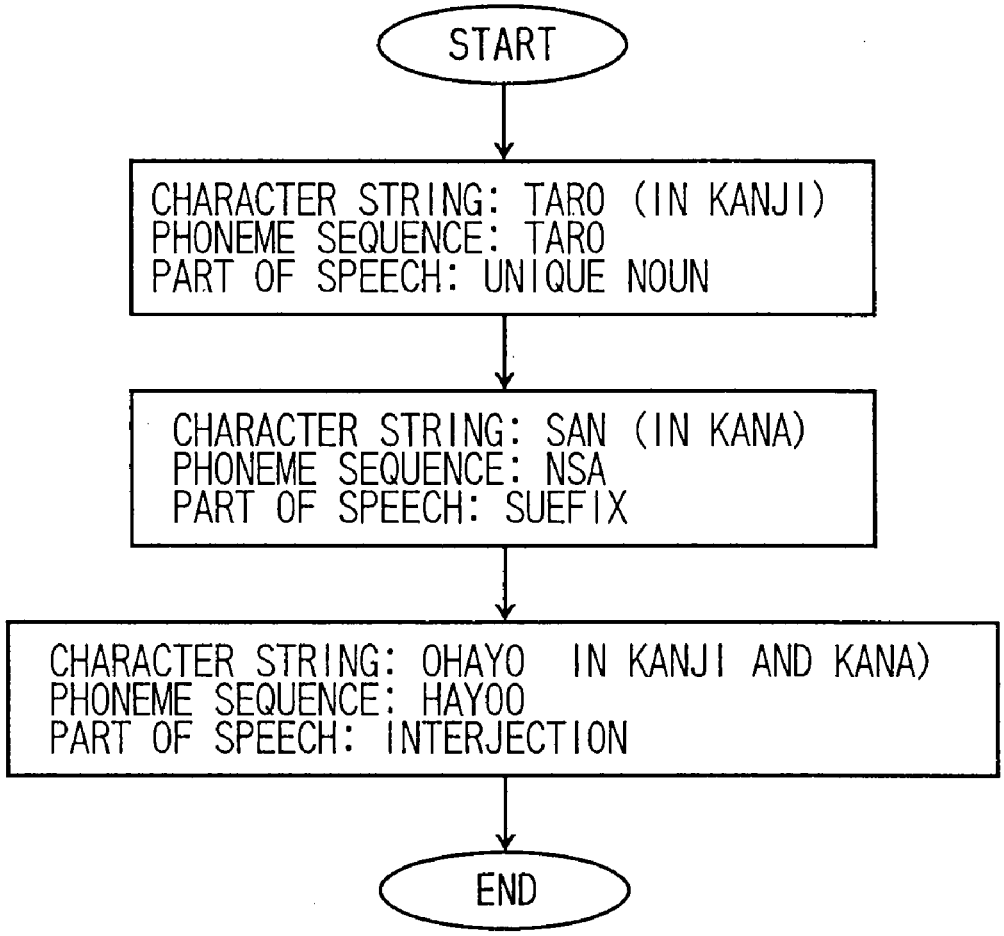
FIG. 15 is an example of output of a analytical result.

As a consequence, the analytic result shown in FIG. 15 is outputted. The outputted phoneme sequence is "taro-nsa-hayooo".

(2-3) Prosody Processing Unit 103

Then, the prosody processing unit 103 generates prosody information on the basis of the phoneme sequence, and the speech synthesizing unit 104 generates the synthesized speech as "taro-nsa-hayooo", which is outputted from the synthesized speech output unit 105.

(3) Advantages

With the speech synthesizing apparatus according to the third embodiment as well, when the text "Taro-san-ohayo." is entered, a speech "taro-nsa-hayooo" is synthesized, and the same effects as the first embodiment are achieved.

Modifications

The invention is not limited to the above-described embodiments, and may be modified in various manners without departing from the scope of the invention.

(1) Modification 1

In the description in the embodiments shown above, the conversion of the phonetic sound is achieved by the replacement of the positions of the phonetic sounds in the word. However, other conversion rules may be used.

For example, a phonetic sound conversion table as shown in FIG. 16A may be employed. This means to replace the entered phonetic sound by the output phonetic sound, and is composed of pairs of phonetic sounds.

In any cases of the replacement and the conversion of the phonetic sound, the conversion table does not necessarily have to be fixed and, for example, a plurality of tables may be switched for use.

These tables do not necessarily have to be such that the output is uniquely determined with respect to the input and, for example as the table shown in FIG. 16B, a configuration in which a plurality of output phonetic sounds correspond to one input phonetic sound, so that the output is changed periodically is also possible. In this example, when "a" is entered, "i" and "o" are outputted alternately.

It does not necessarily have to be changed periodically, and a configuration in which output probability is provided to a plurality of output phonetic sounds which correspond to one input phonetic sound so that the output is determined on the basis of the probability as shown in the table in FIG. 16C. In this example, "i" and "o" are outputted with the 50% probability each for the input of "a".

In this manner, the degree of possibility of analogy of the original text from the converted synthesized speech depending on the method of conversion of the phonetic sound, the setting of the game character or conversion suitable to the state of advancement are advantageously possible.

(2) Modification 2

In the description in the embodiments shown above, the word sequence is outputted as a result of processing in the language processing unit 102. However, the invention is not limited thereto, and it may be outputted in the unit of morpheme or accent phrase.

An example in which the accent phrase is employed as the unit in the first embodiment is shown in FIG. 17.

The registration of the no-conversion list is "Taro" and it does not match the character string of the accent phrase "Taro-san" completely. However, in this case, it is determined that the conversion is not carried out when the registered word in the non-conversion list is included, the accent phrase "Taro-san" is not converted as a whole.

In the case of the accent phrase including a plurality of words, there is a case in which a plurality of part of speech are allocated to one accent phrase. Therefore, when determination is carried out by the non-conversion list of the part of speech, determination whether there is a match with the part of speech sequence of the accent phrase may be carried out by registering the part of speech sequence (for example, "unique noun+suffix") to the list, or by registering one part of speech to the list and determining depending on whether it is included in the part of speech sequence of the accent phrase in the same manner as the character string.

(3) Modification 3

The description in the embodiments shown above, the phonetic sound is a syllable. However, the invention is not limited thereto, and may use the unit of mora or phoneme as the phonetic sound.

When the unit of phoneme is employed, consonants which cannot be continued in Japanese language may be continued as a result of conversion, so that the atmosphere as if it is a foreign language is created.

What is claimed is:

1. A speech processing apparatus comprising:

an input unit configured to enter a text;

a dictionary including sets of a character string which constitutes a word, a phoneme sequence which constitutes pronunciation of the word and a part of speech of the word;

a generating unit configured to divide the text into one or more subtexts on the basis of the dictionary and generate speech information including a phoneme sequence for each divided subtext;

a determining unit configured to cross-check the speech information of the subtext and a list of speech information stored in advance and determine whether or not to carry out conversion of phonetic sounds which belong to the phonetic sound sequence of the subtext; and a processing unit configured to (1) convert each phonetic sound in the phonetic sound sequence of the subtext, which is determined to be carried out the conversion of phonetic sounds, into a different phonetic sound according to a conversion rules stored in advance and output the same, and (2) output the phonetic sound sequence of the subtext, which is determined not to be carried out the conversion of phonetic sounds, without carrying out the conversion.

2. A speech processing apparatus comprising:

an input unit configured to enter a text and determination information which indicates portions to be converted and portions not to be converted into different phonetic sound in the text;

a dictionary including sets of a character string which constitutes a word, a phonetic sound sequence which constitutes pronunciation of the word and a part of speech of the word;

a generating unit configured to divide the text into one or more subtexts on the basis of the dictionary and the determination information and generates information including a phonetic sound sequence with an attribute indicating whether the conversion is necessary or not for each divided subtext; and a processing unit configured to (1) convert each phonetic sound in the phonetic sound sequence of the subtext, whose attribute indicates that the conversion is necessary, into a different phonetic sound according to conversion rules stored in advance and output the same, and (2) output the phonetic sound sequence of the subtext, whose attribute indicates that the conversion is not necessary, without carrying out the conversion.

3. A speech processing apparatus comprising:

an input unit configured to enter a text;

a first dictionary including sets of a character string which constitutes the word whose phonetic sounds are to be converted, a converted phonetic sound sequence in which a combination of phonetic sounds which constitutes pronunciation of the word is converted into a combination of different phonetic sounds on the basis of given conversion rules and a part of speech of the word;

a second dictionary including sets of a character string which constitutes the word whose phonetic sounds are not to be converted, a no-conversion phonetic sound sequence which constitutes pronunciation of the word as it is, and a part of speech of the word; and a processing unit configured to (1) divide the text into one or more subtexts on the basis of the first dictionary and the second dictionary, (2) generate the converted phonetic sound sequence of the subtext included in the first dictionary on the basis of the first dictionary and output the same, and (3) generate the no-conversion phonetic sound sequence of the subtext included in the second dictionary on the basis of the second dictionary and output the same.

4. The apparatus according to claim 1, further comprising:

a prosody generating unit configured to generate prosody information including durations and pitch of the phonetic sounds in the phoneme sequence on the basis of the phoneme sequence for each subtext; and a synthesizing unit for generating a synthesized speech from the phoneme sequence and the prosody information for each subtext.

5. The apparatus according to claim 2, further comprising:

a prosody generating unit configured to generate prosody information including durations and pitch of the phonetic sound in the phoneme sequence on the basis of the phoneme sequence for each subtext; and a synthesizing unit for generating a synthesized speech from the phoneme sequence and the prosody information for each subtext.

6. The apparatus according to claim 3, further comprising:

a prosody generating unit configured to generate prosody information including durations and pitch of the phonetic sound in the phoneme sequence on the basis of the phoneme sequence for each subtext; and a synthesizing unit for generating a synthesized speech from the phoneme sequence and the prosody information for each subtext.

7. The apparatus according to claim 1, wherein the speech information is a character string, a phoneme sequence, or a part of speech sequence, and wherein the determination unit determines whether or not to convert the phonetic sound in the subtext depending on any of;

whether the character string in the subtext includes a character string which is included in a character string list stored in advance or not;

whether the phoneme sequence in the subtext includes a phoneme sequence which is included in a phoneme sequence list stored in advance or not; and whether the part of speech sequence of the subtext includes a part of speech sequence which is included in a part of speech sequence list stored in advance or not.

8. The apparatus according to claim 1, wherein the processing unit stores the conversion rules in a phonetic sound replacement table including sets of a phonetic sound before conversion and a phonetic sound after conversion or a phonetic sound conversion table including sets of a position of phonetic sound in the phoneme sequence before conversion and a position of phonetic sound in the phoneme sequence after conversion.

9. The apparatus according to claim 2, wherein the processing unit stores the conversion rules in a phonetic sound replacement table including sets of a phonetic sound before conversion and a phonetic sound after conversion or a phonetic sound conversion table including sets of a position of phonetic sound in the phoneme sequence before conversion and a position of phonetic sound in the phoneme sequence after conversion.

10. The apparatus according to claim 1, wherein a unit of the subtext is a word, a morpheme, or a phrase.

11. The apparatus according to claim 2, wherein a unit of the subtext is a word, a morpheme, or a phrase.

12. The apparatus according to claim 3, wherein a unit of the subtext is a word, a morpheme, or a phrase.

13. The apparatus according to claim 1, wherein a unit of the phonetic sound is a syllable, a mora, or a phoneme.

14. The apparatus according to claim 2, wherein a unit of the phonetic sound is a syllable, a mora, or a phoneme.

15. The apparatus according to claim 3, wherein a unit of the phonetic sound is a syllable, a mora, or a phoneme.

16. A non-transitory computer-readable medium storing a speech processing program in conjunction with a dictionary including sets of a character string which constitutes a word, a phoneme sequence which constitutes pronunciation of the word and a part of speech of the word, and which when executed by a computer results in performance of steps comprising:

entering a text;

dividing the text into one or more subtexts on the basis of the dictionary and generating speech information including a phoneme sequence for each subtext;

cross-checking the speech information of the subtext and a list of speech information stored in advance and determining whether or not to carry out conversion of phonetic sounds which belong to the phoneme sequence of the subtext; and (1) converting each phonetic sound in the phoneme sequence of the subtext, which is determined to be carried out the conversion of phonetic sounds, into a different phonetic sound according to conversion rules stored in advance and outputting the same, and (2) outputting the phoneme sequence of the subtext, which is determined not to be carried out the conversion of phonetic sound, without carrying out the conversion.

17. A non-transitory computer-readable medium storing a speech processing program in conjunction with a dictionary including sets of a character string which constitutes a word, a phoneme sequence which constitutes pronunciation of the word and a part of speech of the word, and which when executed by a computer results in performance of steps comprising:

entering a text and determination information which indicates portions to be converted and portions not to be converted into different phonetic sound in the text, dividing the text into one or more subtexts on the basis of the dictionary and the determination information and generating information including a phoneme sequence with an attribute indicating whether the conversion is necessary or not for each divided subtext;

(1) converting each phonetic sound in the phoneme sequence of the subtext, whose attribute indicates that the conversion is necessary, into a different phonetic sound according to conversion rules stored in advance and output the same, and (2) outputting the phoneme sequence of the subtext, whose attribute indicates that the conversion is not necessary, without carrying out the conversion.

18. A non-transitory computer-readable medium storing a speech processing program in conjunction with a first dictionary including sets of a character string which constitutes the word whose phonetic sounds are to be converted, a converted phoneme sequence in which a combination of phonetic sounds which constitutes pronunciation of the word is converted into a combination of different phonetic sounds on the basis of given conversion rules and a part of speech of the word; a second dictionary including sets of a character string which constitutes the word whose phonetic sounds are not to be converted, a no-conversion phoneme sequence which constitutes pronunciation of the word as it is, and a part of speech of the word, and which when executed by a computer results in performance of steps comprising:

entering a text;

(1) dividing the text into one or more subtexts on the basis of the first dictionary and the second dictionary, (2) generating the converted phoneme sequence of the subtext included in the first dictionary on the basis of the first dictionary and outputting the same, and (3) generating the no-conversion phoneme sequence of the subtext included in the second dictionary on the basis of the second dictionary and outputting the same.

* * * * *